US006872906B2

(12) United States Patent
Nakazawa et al.

(10) Patent No.: US 6,872,906 B2
(45) Date of Patent: Mar. 29, 2005

(54) MOVABLE CONTACT STRUCTURE AND MOVABLE CONTACT ATTACHING METHOD OF SLIDE SWITCH

(75) Inventors: Takashi Nakazawa, Tokyo (JP); Yukihiro Kakegawa, Tokyo (JP)

(73) Assignee: Niles Co., Ltd. (JP)

( * ) Notice: Subject to any disclaimer, the term of this patent is extended or adjusted under 35 U.S.C. 154(b) by 0 days.

(21) Appl. No.: 10/667,594

(22) Filed: Sep. 23, 2003

(65) Prior Publication Data

US 2004/0074749 A1 Apr. 22, 2004

(30) Foreign Application Priority Data

Sep. 27, 2002 (JP) ..... P2002-282528

(51) Int. Cl.[7] ..... H01H 15/06

(52) U.S. Cl. ..... 200/550; 200/16 A; 200/16 D; 200/283; 200/549; 29/622

(58) Field of Search ..... 200/1 A, 16 R, 200/16 A, 16 D, 1 TK, 547, 549, 550, 252, 283; 29/622

(56) References Cited

U.S. PATENT DOCUMENTS 4,681,987 A * 7/1987 Suwa ..... 200/5 A
4,950,847 A * 8/1990 Billman et al. ..... 200/16 D
5,365,027 A * 11/1994 Marvet et al. ..... 200/16 D
5,875,884 A 3/1999 Tomotoshi
5,967,302 A * 10/1999 Lin ..... 200/550

FOREIGN PATENT DOCUMENTS

JP 4-123038 11/1992
JP 10-134672 A 5/1998

* cited by examiner

*Primary Examiner*—Michael A. Friedhofer
(74) *Attorney, Agent, or Firm*—Rader, Fishman & Grauer, PLLC; Ronald P. Kananen

(57) ABSTRACT

To enable to facilitate integration and part control by reducing a number of parts and a number of integrating steps and restrain electric contact performance from being deteriorated by preventing play, in a slide switch including a pole board (3) having a fixed contact and a movable board (11) made of a resin fixedly supporting a base portion (21) of a movable contact (19) and capable of sliding contact portions (25*a*, 25*b*, 25*c*, 25*d*, 25*e*), at a front end of the movable contact (19) relative to the fixed contact by moving along the pole board (3), the base portion (21) of the movable contact (19) is formed in a shape of a flat plate, the base portion (21) of the movable contact (19) is fixed to the movable board (11) by insert-molding of the resin and the movable contact (19) is inclinedly supported by the movable board (11).

4 Claims, 6 Drawing Sheets

Fig.1
Fig. 1A
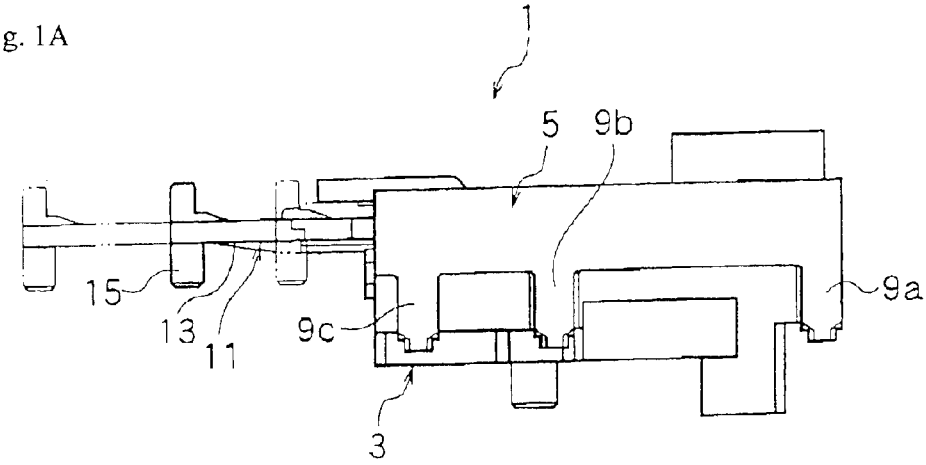
Fig. 1B
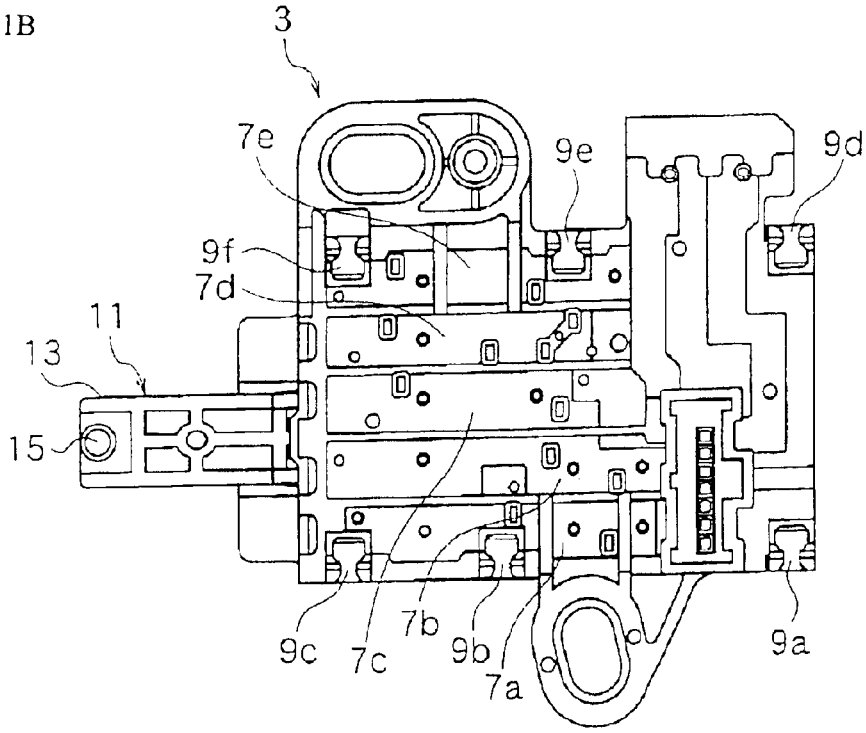

Fig.2
Fig. 2A
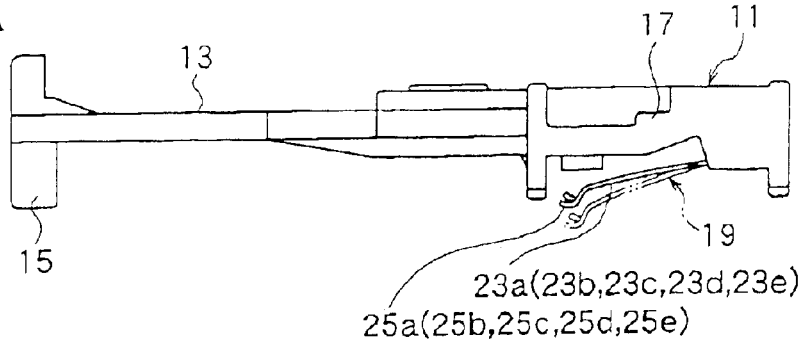
Fig. 2B
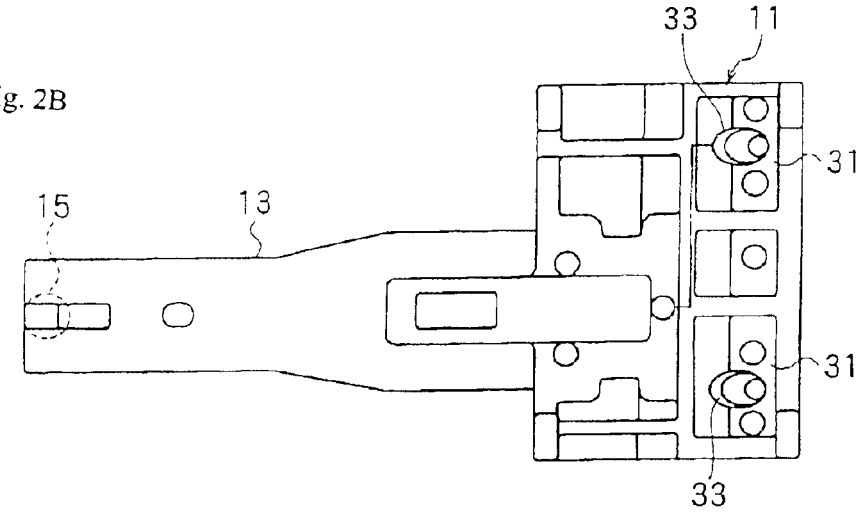
Fig. 2C
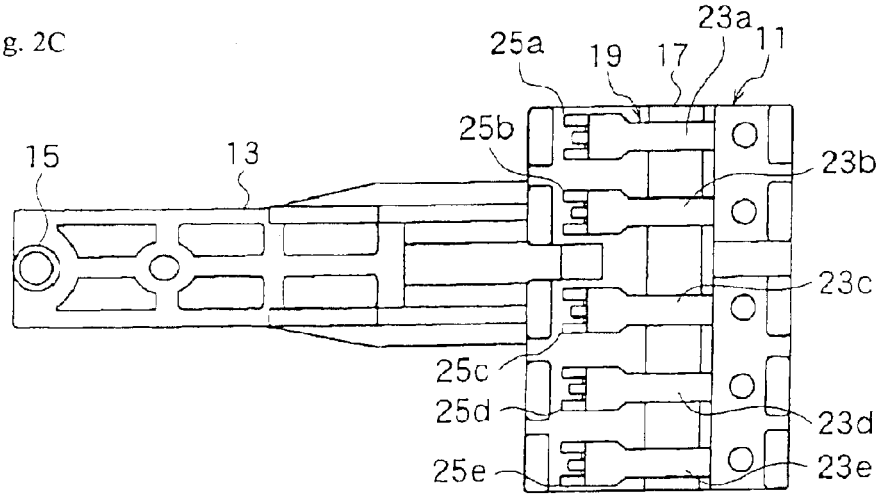

Fig.10
PRIOR ART
Fig. 10A
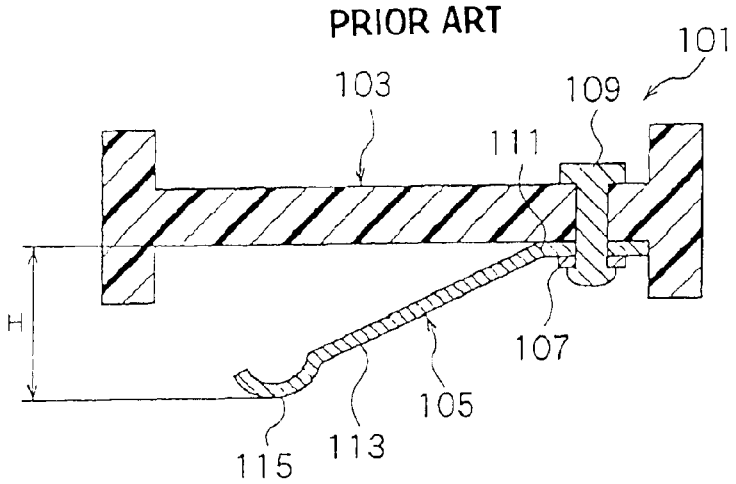
Fig. 10B
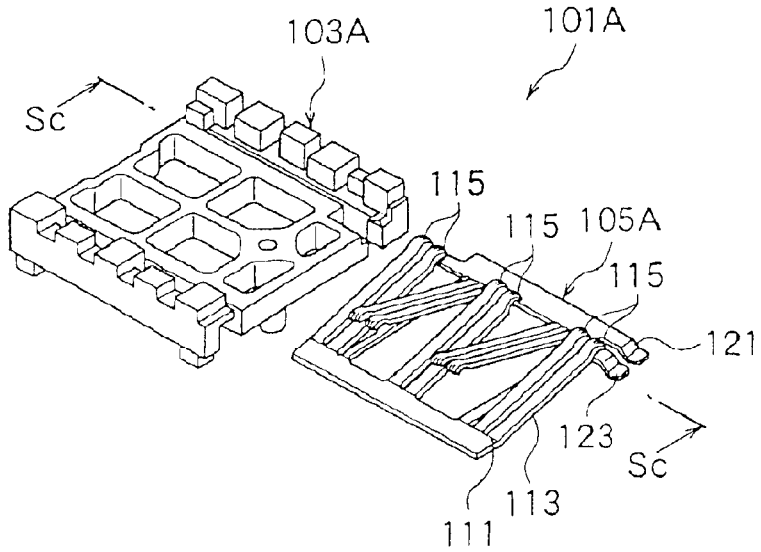
Fig. 10C
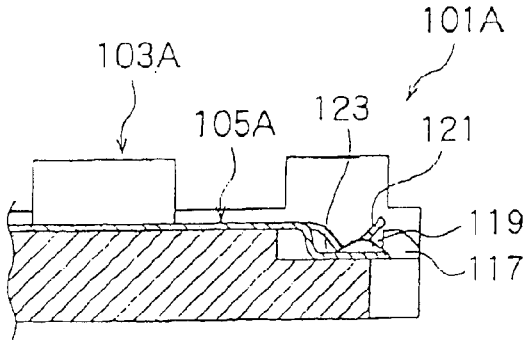

MOVABLE CONTACT STRUCTURE AND MOVABLE CONTACT ATTACHING METHOD OF SLIDE SWITCH

BACKGROUND OF THE INVENTION

1. Field of the Invention

The present invention relates to a movable contact structure and a movable contact attaching method of a slide switch applied to an inhibitor switch for detecting a shift position of an automobile.

2. Description of the Related Art

A movable board as shown by, for example, FIG. 10A or FIG. 10B is used for an inhibitor switch as a slide switch of a related art. FIG. 10A is a sectional view of a movable board, FIG. 10B is a disassembled perspective view of a movable board according to other related art and FIG. 10C is a partially enlarged sectional view in view from arrow marks Sc—Sc of FIG. 10B.

First, according to a movable board 101 of FIG. 10A, a movable contact 105 is fixed to a movable board main body 103 made of resin by calking a rivet 109 via a washer 107. The movable contact 105 is formed with a bent portion 111 and a contact arm 113 is arranged to incline relative to the movable board main body 103 by the bent portion 111. A contact portion 115 of the movable contact 105 is at a distance of H from the movable board main body 103 in a free state and the contact portion 115 is constituted to be brought into elastic contact with a side of a fixed contact by predetermined contact pressure (for example, refer to Patent Literature 1).

According to a movable board 101A of FIG. 10B, a movable contact 105A is inserted into a movable board main body 103A from a side direction to be fixed thereto by so-to-speak snap fit. That is, as shown by FIG. 10B and FIG. 10C, the movable main body 103A is provided with a stepped portion 117 and an engaging portion 119 and the movable contact 105A is provided with play preventive pieces 121 and 123. When the movable contact 105A is inserted into the movable contact main body 103A from the side direction, the play preventive pieces 121 ad 123 are engaged with the stepped portion 117 and the engaging portion 119 and the fixed contact 105A can be integrated to the movable board main body 103A by one touch motion (for example, refer to Patent Literature 2).

(Patent Literature 1)

JP-UM-A-4-123038 (FIG. 8, FIG. 9)

(Patent Literature 2)

JP-A-10-134672 (page 3, FIG. 2)

However, the movable board 101 of FIG. 10A needs the rivet 109 and the washer 107 as fixing parts and needs a step of integrating the rivet 109 and the washer 107 and a step of calking the rivet 109 in integration. Therefore, there poses a problem that integration and part control are very complicated.

In contrast thereto, according to the movable board 101A of FIGS. 10B and 10C, fixing is carried out by the snap fit and therefore, there is an advantage of dispensing with the rivet or the like and facilitating integration and part control.

However, there poses a problem that play is liable to be produced between the play preventive pieces 121 and 123 and the stepped portion 117 and the engaging portion 119 and the contact portion 115 of the movable contact 105A is rattled relative to a fixed contact and accuracy of switching ON/OFF is difficult to achieve sufficiently.

SUMMARY OF THE INVENTION

It is a problem of the invention to facilitate integration and part control by reducing a number of parts, make play of a movable contact difficult to be brought about, facilitate accurate positioning of a position of a contact portion and restrain electric contact performance from being deteriorated.

A first aspect of the invention is a movable contact structure of a slide switch, the slid switch comprising a pole board having a fixed contact, and a movable board made of a resin fixedly supporting a base portion of a movable contact and capable of sliding a contact portion at a front end of the movable contact relative to the fixed contact by a predetermined contact pressure by moving along the pole board, wherein the base portion of the movable contact is formed in a shape of a flat plate, the base portion of the movable contact is fixed to the movable board by insert-molding of the resin and the movable contact is inclinedly supported by the movable board.

A second aspect of the invention is a method of attaching a movable contact of a slide switch, the slide switch comprising a pole board having a fixed contact, and a movable board made of a resin fixedly supporting a base portion of a movable contact and capable of sliding a contact portion at a front end of the movable contact relative to the fixed contact by a predetermined contact pressure by moving along the pole board, the method comprising the steps of forming the base portion of the movable contact in a shape of a flat plate, fixing the base portion of the movable contact to the movable board by insert-molding of the resin, and inclinedly supporting the movable contact by the movable board.

A third aspect of the invention is a method of attaching a movable contact of a slide switch, the slide switch comprising a pole board having a fixed contact, and a movable board made of a resin fixedly supporting a base portion of a movable contact and capable of sliding a contact portion at a front end of the movable contact relative to the fixed contact by a predetermined contact pressure by moving along the pole board, the method comprising the steps of providing a positioning hole at the base portion of the movable plate, and fixedly supporting the base portion of the movable contact by the movable board by insert-molding of the resin by positioning the movable contact to a die by fitting a positioning pin of the die to the positioning hole.

A fourth aspect of the invention is the method of attaching a movable contact of a slide switch according to the third aspect, wherein the positioning pin of the die comprising a large diameter portion fixed to a support hole on a side of the die, and a small diameter portion fitted to the positioning hole of the movable contact, wherein a positioning position of the movable contact is changed by changing a position of the small diameter portion relative to the die by changing a boldness of the large diameter portion.

According to the first aspect of the invention, in the slide switch comprising the pole board having the fixed contact and the movable board made of the resin fixedly supporting the base portion of the movable contact and capable of sliding the contact portion at the front end of the movable contact relative to the fixed contact by the predetermined contact pressure by moving along the pole board, it is possible that the base portion of the movable contact is formed in the shape of the flat plate, the base portion of the movable contact is fixed to the movable board by insert-molding of the resin and the movable contact is inclinedly supported by the movable board.

Therefore, it is possible in attaching the movable contact to the movable board to dispense with a rivet or the like, reduce a number of parts and a number of integrating steps and facilitate integration and part control.

Further, since the movable contact is fixedly supported by the movable board by insert-molding of the resin, play of the movable contact is made to be difficult to be brought about relative to the movable board and accurate positioning of the contact portion can easily be carried out.

Further, since the base portion of the movable contact is in the shape of flat plate, a dispersion in fabrication by presence of a bent portion is eliminated, deformation in transportation is restrained, a dispersion in the contact pressure of the contact portion of the movable contact applied on the fixed contact is restrained and electric contact performance can be restrained from being deteriorated.

According to the second aspect of the invention, in the slide switch comprising the pole board having the fixed contact and the movable board made of the resin fixedly supporting the base portion of the movable contact and capable of sliding the contact portion at the front end of the movable contact relative to the fixed contact by the predetermined contact pressure by moving along the pole board, it is possible to form the base portion of the movable contact in the shape of the flat plate, fix the base portion of the movable contact to the movable board by insert-molding of the resin and inclinedly support the movable contact by the movable board.

Therefore, it is possible in attaching the movable contact to the movable board to dispense with a rivet or the like, reduce a number of parts and a number of integrating steps and facilitate integration and part control.

Further, since the movable contact is fixedly supported by the movable board by insert-molding of the resin, play of the movable contact is made to be difficult to be brought about relative to the movable board and accurate positioning of the contact portion can easily be carried out.

Further, since the base portion of the movable contact is in the shape of flat plate, a dispersion in fabrication by presence of a bent portion is eliminated, deformation in transportation is restrained, a dispersion in the contact pressure of the contact portion of the movable contact applied on the fixed contact is restrained and electric contact performance can be restrained from being deteriorated.

According to the third aspect of the invention, in the slide switch comprising the pole board having the fixed contact and the movable board made of the resin fixedly supporting the base portion of the movable contact and capable of sliding the contact portion at the front end of the movable contact relative to the fixed contact by the predetermined contact pressure by moving along the pole board, it is possible to provide the positioning hole at the base portion of the movable contact and fixedly support the base portion of the movable contact by the movable board by insert-molding of the resin by positioning the movable contact relative to the die by fitting the positioning pin of the die to the positioning hole.

Therefore, it is possible in attaching the movable contact to the movable board to dispense with a rivet or the like, reduce a number of parts and a number of integrating steps and facilitate integration and part control.

Further, since the movable contact is fixedly supported by the movable board by insert-molding of the resin, play of the movable contact is made to be difficult to be brought about relative to the movable board and accurate positioning of the contact portion can easily be carried out.

Further, since the movable contact is positioned relative to the die by fitting the positioning pin of the die to the positioning hole of the movable contact, accuracy of positioning the movable contact to the movable contact is promoted and accurate positioning of the contact portion can be carried out further accurately.

According to the fourth aspect of the invention, in addition to an effect of the third aspect of the invention, the positioning pin of the die comprises the large diameter portion fixed to the support hole on the side of the die and the small diameter portion fitted to the positioning hole of the movable contact, the positioning position of the movable contact is changed by changing the position of the small diameter portion relative to the die by changing the boldness of the large diameter portion and therefore, the position of the contact portion of the movable contact can easily be adjusted.

BRIEF DESCRIPTION OF THE DRAWINGS

FIGS. 1A and 1B show an inhibitor switch to which an embodiment of the invention is applied, FIG. 1A is a side view and FIG. 1B is a bottom view;

FIGS. 2A, 2B and 2C relate to the embodiment, FIG. 2A is a side view of a movable board, FIG. 2B is a top view of the movable board and FIG. 2C is a bottom view of the movable board;

FIGS. 10A, 10B and 10C relate to related arts, FIG. 10A is a sectional view of a movable board, FIG. 10B is a disassembled perspective view of a movable board according to other related art and FIG. 10C is a sectional view enlarging an essential portion of FIG. 10B in view from arrow marks Sc—Sc.

DETAILED DESCRIPTION OF THE PREFERRED EMBODIMENTS

Figure 3:
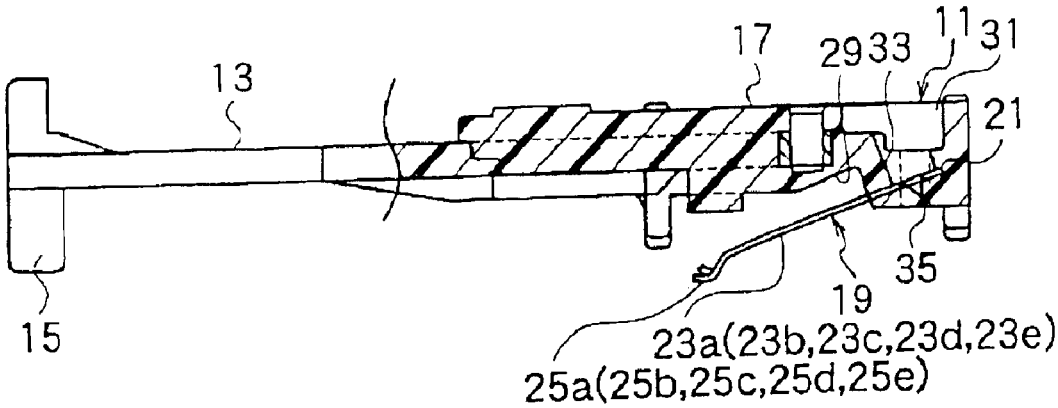
FIG. 3 is a partial sectional side view of the movable board according to the embodiment.

FIGS. 1A and 1B show an inhibitor switch having a movable contact structure attached by a movable contact attaching method of a slide switch according to an embodiment of the invention, FIG. 1A is a side view and FIG. 1B is a bottom view.

In FIGS. 1A and 1B, an inhibitor switch 1 is provided with a pole board 3 and a cover 5. The pole board 3 is formed by an insulating resin and upper inner face sides of respective grooves 7*a*, 7*b*, 7*c*, 7*d* and 7*e* of the pole board 3 are respectively provided with fixed contacts by insert-molding. The cover 5 is made of a metal and respective legs 9*a*, 9*b*, 9*c*, 9*d*, 9*e* and 9*f* thereof are calked to the pole board 3.

A movable board 11 is slidably arranged at an inner face side of the pole board 3 and a shaft 13 made of a metal integrally provided to the movable board 11 is projected from one-end sides of the pole board 3 and the cover 5. A connecting pin 15 is projected from the shaft 13 and cooperatively connected to a side of a manual valve.

Figure 4:
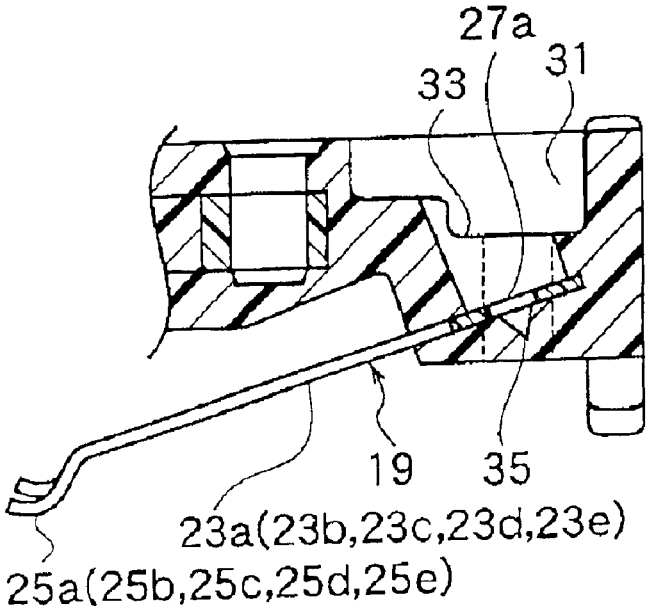
FIG. 4 is a sectional view enlarging an essential portion of the movable board according to the embodiment.

A total constitution of the movable board 11 is as shown by FIGS. 2A, 2B, 2C, 3 and 4. FIG. 2A is a side view of the movable board, FIG. 2B is a top view, FIG. 2C is a bottom view, FIG. 3 is a partial sectional side view of the movable board 11 and FIG. 4 is a sectional view enlarging an essential portion of the movable board 11.

As shown by FIGS. 2A, 2B, 2C, 3 and 4, the movable board 11 is provided with a movable board main body 17 made of resin and the movable board main body 17 is integrally attached with the shaft 13 made of a metal. A movable contact 19 made of a metal is fixed to the movable board main body 17 made of resin by insert-molding and supported thereby to incline.

Figure 5:
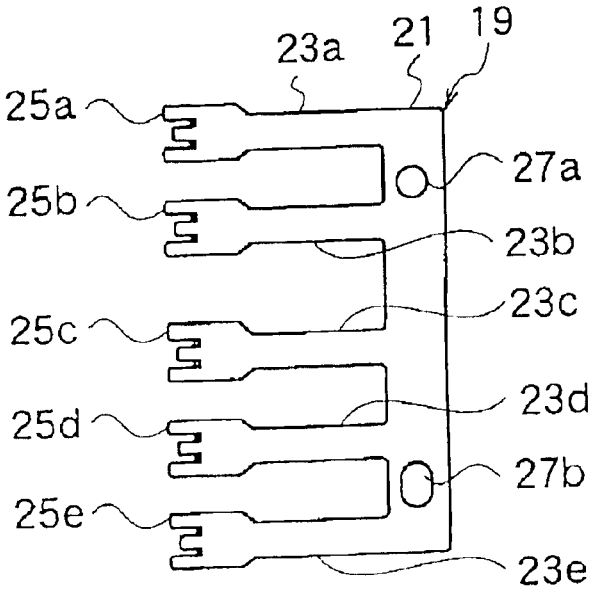
FIG. 5 is a bottom view of a movable contact according to the embodiment.

Also in reference to a plane view of the movable contact of FIG. 5, the movable contact 19 is projected with a plurality of pieces, for example, five pieces of contact arms 23*a*, 23*b*, 23*c*, 23*d* and 23*e* from a base portion 21 thereof. The base portion 21 is formed in a shape of a flat plate and the respective contact arms 23*a*, 23*b*, 23*c*, 23*d* and 23*e* are projected straightly from the base portion 21 in the flat plate shape. Contact portions 25*a*, 25*b*, 25*c*, 25*d* and 25*e* are provided at front ends of the respective contact arms 23*a*, 23*b*, 23*c*, 23*d* and 23*e*. Further, positioning holes 27*a* and 27*b* are provided at the base portion of the movable contact 19. The positioning hole 27*a* is formed by a circular hole and the positioning holes 27*b* is formed by a long hole.

Further, as described above, the base portion of the movable contact 19 is fixed to the movable board main body 17 of the movable board 11 by insert-molding of resin and the movable contact 19 is supported by the movable board main body 17 to incline as shown by FIG. 3 and FIG. 4.

The movable body main body 17 is provided with a recessed portion 29 continuous in a width direction (direction orthogonal to the paper face in FIG. 3 and FIG. 4). The recessed portion 29 is opposed to the respective contact arms 23*a*, 23*b*, 23*c*, 23*d* and 23*e* and allows elastic deformation of the respective contact arms 23*a* through 23*e*.

In insert-molding of the movable contact 19, by fitting positioning pins of a die to the positioning holes 27*a* and 27*b*, the movable contact 19 is positioned relative to the die. Therefore, at the movable board main body 17, there are present a recessed portion 31 formed by bringing in a portion of the die, a cylindrical hole 33 formed by bringing in a portion of the positioning pin and a conical hole 35 formed by bringing in a front end of the positioning pin.

Figure 6:
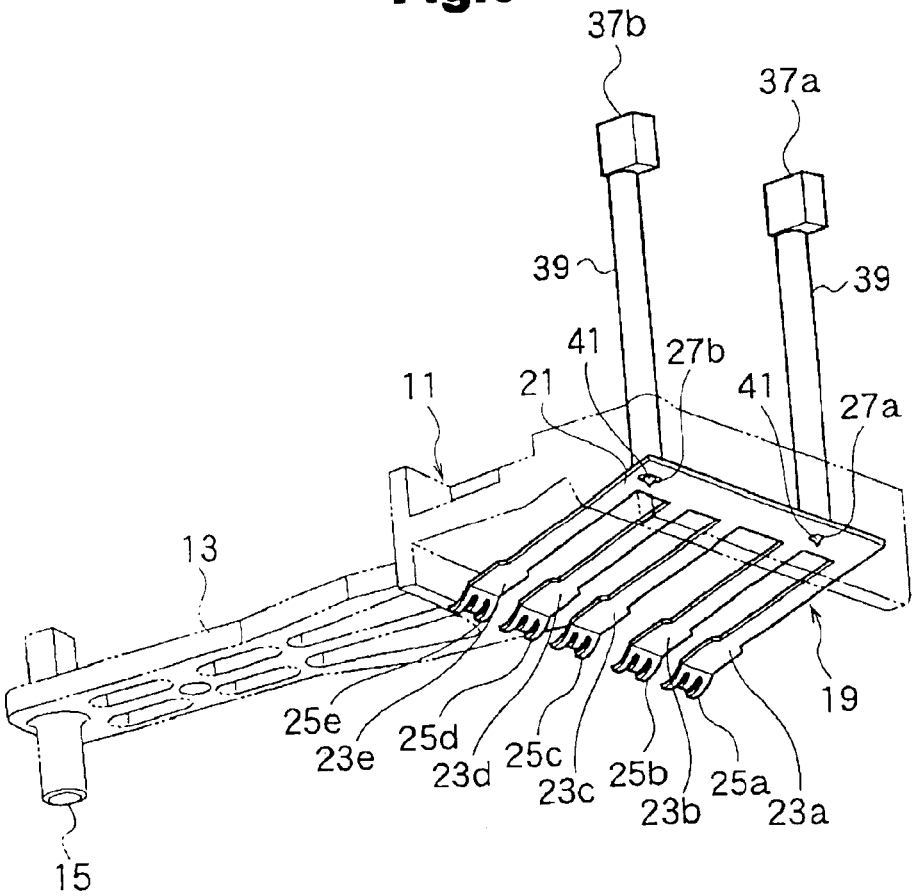
FIG. 6 is a perspective view showing a relationship between a positioning pin and the movable contact according to the embodiment.
Figure 7:
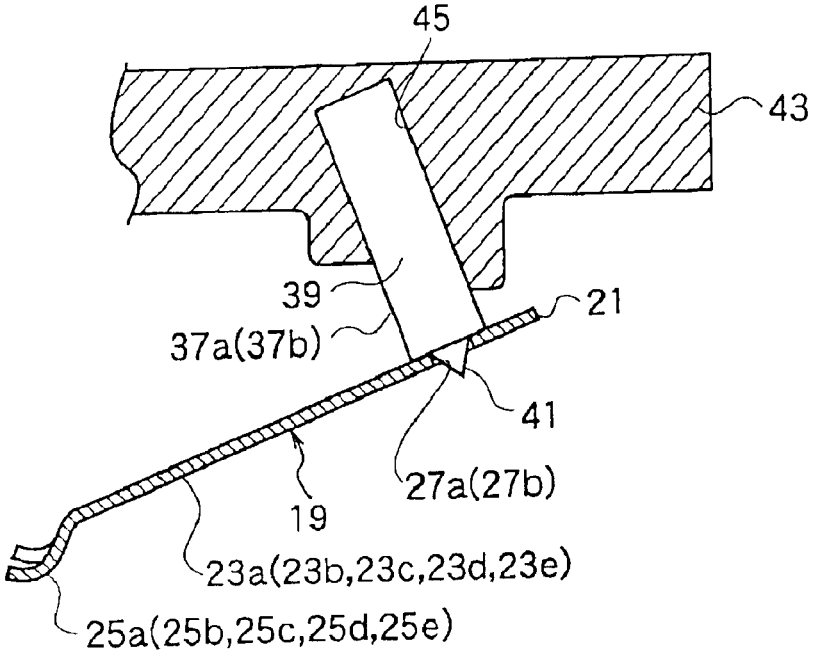
FIG. 7 is a sectional view of an essential portion showing the relationship between the position pin and the movable contact according to the embodiment.
Figure 8:
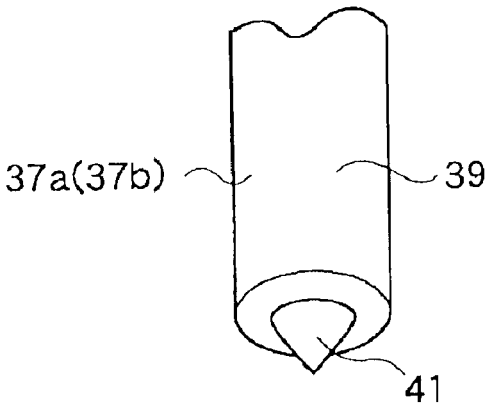
FIG. 8 is a perspective view of an essential portion of the positioning pin according to the embodiment.

The positioning pin of the die is as shown by FIG. 6 through FIG. 8. FIG. 6 is a perspective view showing a relationship between positioning pins 37*a* and 37*b* and the movable contact 19, FIG. 7 is a sectional view of an essential portion showing the relationship between the positioning pins 37*a* and 37*b* and the movable contact 19 and FIG. 8 is a perspective view of essential portions of the positioning pins 37*a* and 37*b*.

As shown by FIG. 6 through FIG. 8, the positioning pins 37*a* and 37*b* each comprises a large diameter portion 39 and a small diameter portion 41. The small diameter portion 41 is a formed in a conical shape. The positioning pins 37*a* and 37*b* are fixed to support holes 45 provided on a side of a die 43 as shown by FIG. 7. The movable contact 19 is positioned to the side of the die 43 by respectively fitting the respective small diameter portion 41 of the positioning pins 37*a* and 37*b* to the positioning holes 27*a* and 27*b* of the movable contact 19.

Further, since the positioning hole 27*b* is constituted by the long hole, even when an error is brought about between the positioning holes 27*a* and 27*b* and the positioning pins 37*a* and 37*b* in a direction relative to each other, the error can be absorbed by the side of the positioning hole 27*b* of the long hole.

Further, by insert-molding of resin in a state in which the movable contact 19 is positioned by the positioning pin 37*a* and 37*b*, the movable contact 19 can be fixed to the movable board main body 17 of resin to be inclinedly supported thereby as shown by FIG. 2A through FIG. 4.

Further, the positioning position of the movable contact 19 can be changed by changing a portion of the small diameter portion 41 relative to the die 43 by changing boldness of the positioning pins 37*a* and 37*b* such as by increasing their diameters.

Figure 9:
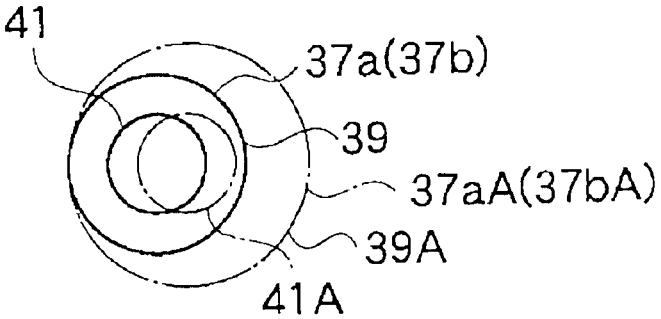
FIG. 9 is an explanatory view of changing a position of positioning the movable contact by changing a boldness of the positioning pin according to the embodiment.

FIG. 9 is an explanatory view of changing the boldness of the positioning pin 37*a* (37*b*) and when the boldness of the large diameter portion 39 of the positioning pin 37*a* (37*b*) is increased to constitute a positioning pin 37*a*A (37*b*A) having the large diameter portion 39A as shown by FIG. 9, and a center of the small diameter portion 41 is changed to constitute a small diameter portion 41A. Therefore, the position of the small diameter portion 41 can be changed to constitute the small diameter portion 41A by supporting the positioning pin having the large diameter portion 39A by enlarging the diameter of the support hole 45 of the die 43.

Therefore, when the position of the movable contact 19 is intended to change by, for example, 5/100 mm, the position can easily be adjusted by changing the boldness of the large diameter portion 39 of the positioning pin 37*a* or 37*b* as shown by FIG. 9 to constitute the large diameter portion 39A.

Further, although there are exemplified the small diameter portions 41 and 41A respectively disposed at the centers of the large diameter portions 39 and 39A, it is not necessarily needed that the small diameter portions 41 and 41A are disposed at the centers. In sum, when an initial set position thereof needs to change, since it is easy to enlarge the support hole 45 of the die 43 for supporting the initial positioning pin 37*a* or 37*b*, the large diameter portion 39A may be made to be bolder than the large diameter portion 39 and the small diameter portion 41A may be set at a pertinent position of the large diameter portion 39A.

As described above, when the movable contact 19 is attached to the movable board 11, a rivet or the like can be dispensed with, a number of parts and a number of integrating steps can be reduced and integration and part control can be facilitated.

Further, since the movable contact 19 is fixedly supported by the movable board 11 by insert-molding of resin, play of the movable contact 19 relative to the movable board 11 is difficult to be brought about and accurate positioning of the contact portions 25*a*, 25*b*, 25*c*, 25*d* and 25*e* can easily be carried out.

Here, according to the related arts of FIGS. 10A, 10B and 10C, the height H of spring of the movable contact 105 is set by providing the bent portion 111 at the movable contact 105 or 105A and contact pressure of the contact portion 115 applied to the fixed point is adjusted based on the height H. Therefore, there is a concern of dispersing the contact pressure by an error in a bending step of the bent portion 111. Further, there is a concern that the bent portion 111 is liable to deform in transportation and the contact pressure is dispersed by the deformation. Therefore, there is a concern of deteriorating electric contact performance of the movable contact 105.

In contrast thereto, according to the embodiment of the invention, the base portion 21 of the movable contact 19 is in the flat plate shape and therefore, there is not the dispersion in fabrication by presence of the bent portion and the deformation in transportation is restrained, the dispersion of the contact pressure of the contact portions 25*a*, 25*b*, 25*c*, 25*d*, 25*e* of the movable contact 19 relative to the fixed point is restrained and the deterioration of the electric contact performance can be restrained.

Further, since the movable contact 19 is positioned relative to the die 43 by fitting the positioning pins 37*a* and 37*b* of the die 43 to the positioning holes 27*a* and 27*b* of the movable contact 19, accuracy of positioning the movable contact 19 relative to the movable board 11 is promoted and accurate positioning of the contact portions 25*a*, 25*b*, 25*c*, 25*d* and 25*e* can further accurately be carried out.

Further, since the positioning position of the movable contact 19 is changed by changing the position of the small diameter portion 41 relative to the die by changing the boldness of the large diameter portion 39 of the positioning pin 37*a* or 37*b*, positions of the contact portions 25*a*, 25*b*, 25*c*, 25*d* and 25*e* of the movable contact 19 can easily be adjusted.

Further, according to the inhibitor switch 1, when a driver operates the manual valve by operating a shift lever, the movable board 11 is moved relative to the pole board 3 via the pin portion 15 of FIG. 1. Thereby, the respective contact portions 25*a*, 25*b*, 25*c*, 25*d* and 25*e* of the movable contact 19 are made to be ON/OFF relative to the fix contacts on the side of the pole board 3 to selectively conduct the respective fixed points to thereby enable to detect a shift position of an automatic transmission.

Although according to the embodiment, an explanation has been given of the slide switch as the inhibitor switch, the slide switch can also be constituted as other switch.

Although according to the embodiment, the pin portion 15 is provided at the shaft 13 integrally provided with the movable board main body 17 to cooperatively connect to the side of the manual valve, a constitution of directly providing the pin portion at the movable board main body 17 can be constructed.

Although according to the embodiment, the base portion 21 of the movable contact 19 is formed in the flat plate shape and fixedly supported by the movable board main body 17 by insert-molding by positioning using the positioning pins 37*a* and 37*b*, when the base portion 21 of the movable contact 19 is formed in the flat plate shape, the movable contact 19 can be constituted to be fixedly supported by the movable board main body 17 by the insert-molding by other method regardless of the structure of using the positioning pins.

Further, there can also be constructed a structure of providing the bent portion at the movable contact 19 as in the related art and a constitution in which the movable contact 19 is fixedly supported by the movable board main body 17 by insert-molding by the positioning structure using the positioning pins.

What is claimed is:

1. A movable contact structure of a slide switch, said slide switch comprising:

a pole board having a fixed contact; and a movable board made of a resin fixedly supporting a base portion of a movable contact and capable of sliding a contact portion at a front end of the movable contact relative to the fixed contact by a predetermined contact pressure by moving along the pole board, wherein the base portion of the movable contact is formed in a shape of a flat plate, the base portion of the movable contact is fixed to the movable board by insert-molding of the resin and the movable contact is inclinedly supported by the movable board.

2. A method of attaching a movable contact of a slide switch, said slide switch comprising:

a pole board having a fixed contact; and a movable board made of a resin fixedly supporting a base portion of a movable contact and capable of sliding a contact portion at a front end of the movable contact relative to the fixed contact by a predetermined contact pressure by moving along the pole board, said method comprising the steps of:

forming the base portion of the movable contact in a shape of a flat plate;

fixing the base portion of the movable contact to the movable board by insert-molding of the resin; and inclinedly supporting the movable contact by the movable board.

3. A method of attaching a movable contact of a slide switch, said slide switch comprising:

a pole board having a fixed contact; and a movable board made of a resin fixedly supporting a base portion of a movable contact and capable of sliding a contact portion at a front end of the movable contact relative to the fixed contact by a predetermined contact pressure by moving along the pole board, said method comprising the steps of:

providing a positioning hole at the base portion of the movable plate; and fixedly supporting the base portion of the movable contact by the movable board by insert-molding of the resin by positioning the movable contact to a die by fitting a positioning pin of the die to the positioning hole.

4. A method of attaching a movable contact of a slide switch, said slide switch comprising:

a pole board having a fixed contact; and a movable board made of a resin fixedly supporting a base portion of a movable contact and capable of sliding a contact portion at a front end of the movable contact relative to the fixed contact by a predetermined contact pressure by moving alone the role board, said method comprising the steps of:

providing a positioning hole at the base portion of the movable plate; and fixedly supporting the base portion of the movable contact by the movable board by insert-molding of the resin by positioning the movable contact to a die by fitting a positioning pin of the die to the positioning hole wherein the positioning pin of the die comprising:

a large diameter portion fixed to a support hole on a side of the die; and a small diameter portion fitted to the positioning hole of the movable contact;

wherein a positioning position of the movable contact is changed by changing a position of the small diameter portion relative to the die by changing a boldness of the large diameter portion.

* * * * *

UNITED STATES PATENT AND TRADEMARK OFFICE

CERTIFICATE OF CORRECTION

PATENT NO. : 6,872,906 B2
DATED : March 29, 2005
INVENTOR(S) : Takashi Nakazawa

It is certified that error appears in the above-identified patent and that said Letters Patent is hereby corrected as shown below:

Column 8,
Line 48, change “role” to -- pole --.

Signed and Sealed this

Thirteenth Day of September, 2005

JON W. DUDAS
*Director of the United States Patent and Trademark Office*